US005396679A

United States Patent [19]

Brown et al.

[11] Patent Number: 5,396,679

[45] Date of Patent: Mar. 14, 1995

[54] TOOTHBRUSH WITH REPLACEABLE BRUSH INSERT

[75] Inventors: Steven R. Brown, 601 4th St. #323, San Francisco, Calif. 94107; Gary J. Banik, Portland, Oreg.; John M. Franz, Hoffman Estates, Ill.

[73] Assignee: Steven R. Brown, San Francisco, Calif.

[21] Appl. No.: 192,848

[22] Filed: Feb. 7, 1994

[51] Int. Cl.[6] ..... A46B 9/04

[52] U.S. Cl. ..... 15/167.1; 15/176.4

[58] Field of Search ..... 15/167.1, 176.1, 176.4–176.6, 15/194, 202

[56] References Cited

U.S. PATENT DOCUMENTS

| | | | |
|---|---|---|---|
| 1,800,993 | 4/1931 | Funk . | |
| 2,225,331 | 12/1940 | Campbell | 15/188 |
| 2,618,003 | 11/1952 | Robey . | |
| 4,411,041 | 10/1983 | Braga | 15/176.4 |
| 4,543,679 | 10/1985 | Rosofsky et al. | 15/176.4 |
| 4,780,924 | 11/1988 | Hansen et al. | 15/176.1 |
| 4,890,349 | 1/1990 | Nitzsche | 15/167.1 |

FOREIGN PATENT DOCUMENTS

| | | | |
|---|---|---|---|
| 2226133 | 11/1974 | France | 15/176.4 |
| 180343 | 1/1907 | Germany | 15/176.4 |
| 1910180 | 2/1970 | Germany . | |
| 2107899 | 8/1972 | Germany | 15/176.4 |
| 2311043 | 9/1974 | Germany | 15/176.4 |
| 2434268 | 1/1976 | Germany . | |
| 3038895 | 8/1982 | Germany . | |
| 3345605 | 6/1985 | Germany | 15/167.1 |
| 3416874 | 11/1985 | Germany | 15/176.1 |
| 428661 | 7/1967 | Switzerland . | |

*Primary Examiner*—Mark Spisich
*Attorney, Agent, or Firm*—Limbach & Limbach

[57] ABSTRACT

A tooth brush having a replaceable brush insert complementally receivable in an open loop formed at one end of an elongate handle. The loop is of a symmetrical ovoid configuration. A bead extends fully around the insert and snaps to one side of the loop to secure the insert within the loop. A flange extends around the insert for sealed engagement with the loop upon secure receipt of the insert within the loop.

14 Claims, 1 Drawing Sheet

TOOTHBRUSH WITH REPLACEABLE BRUSH INSERT

BACKGROUND OF THE INVENTION

The present invention relates to a toothbrush having a readily releasable and replaceable brush insert which is securely and hygienically held in place. In its more particular aspects, it is concerned with such a brush wherein the insert is received in an open loop at one end of the brush handle and may be readily snapped into and out of secured sealed engagement with the loop.

The prior art teaches brushes with replaceable brush inserts. For various reasons, however, these have not had significant commercial success for use as oral hygiene instruments. The problems have been complexity and expense, difficulty in use, awkwardness, and concern that they pose a hygienic risk.

Early examples of toothbrushes with replaceable inserts are seen in U.S. Pat. Nos. 1,800,993, 2,225,331 and 2,618,003. The brushes of these patents do not provide the hygienic seal and simplified construction of the present invention. In some instances, they also provide cavities within the brush insert or handle which can cause hygienic problems. U.S. Pat. No. 4,780,924 discloses a toothbrush which has an entire head which may be removed. A recent example of a toothbrush with a replaceable brush insert is seen in U.S. Pat. No. 4,890,349 wherein the handle is formed with either a non-symmetrical opening to facilitate ejection of the insert, or a closed cavity with resilient back.

Other examples of brushes with replaceable inserts are found in the foreign art. See, for example, Swiss Patent No. 428,661 and German Patent Nos. 1910180, 2434268 and 3038895.

SUMMARY OF THE INVENTION

The brush of the present invention has an elongate handle with a symmetric open loop at one end. The brush insert is of a shape complemental to that of the loop and formed with a flange on its bristle side which sealingly engages one side of the loop when the insert is received within the handle. A bead is formed on and extends around the insert for snapping engagement with the loop to releasably secure the insert in place and form a seal to the side of the loop opposite that engaged by the flange.

A principle object of the invention is to provide a toothbrush with a replaceable brush insert which is securely held in place and easily releasable.

Another object of the invention is to provide such a brush which is of a simplified construction and capable of being economically mass produced.

Still another object of the invention is to provide such a brush which may be fabricated of polymers with no metal parts and provides a hygienically safe seal between the handle and the brush insert.

Still another object of the invention related to the latter object is to provide such a brush wherein there are no closed cavities within the handle or insert which pose a hygienic risk.

A further object of the invention is to provide such a brush wherein the receptacle within the handle is of a symmetrical open loop configuration and the insert is of a complemental shape which may be reversed end-for-end within the loop.

Yet another object related to the latter object is to provide such a brush wherein the loop is formed with a shoulder which provides a reinforcing function and serves as a retaining and sealing surface for engagement by a bead formed on the insert.

DESCRIPTION OF THE PREFERRED EMBODIMENT

The brush is designated in its entirety by the letter B and comprises, as its basic elements, a handle H and a brush insert I. Both the handle and insert are fabricated of a relatively high density polymer, such as 0.0903 density polypropylene.

Figure 1:
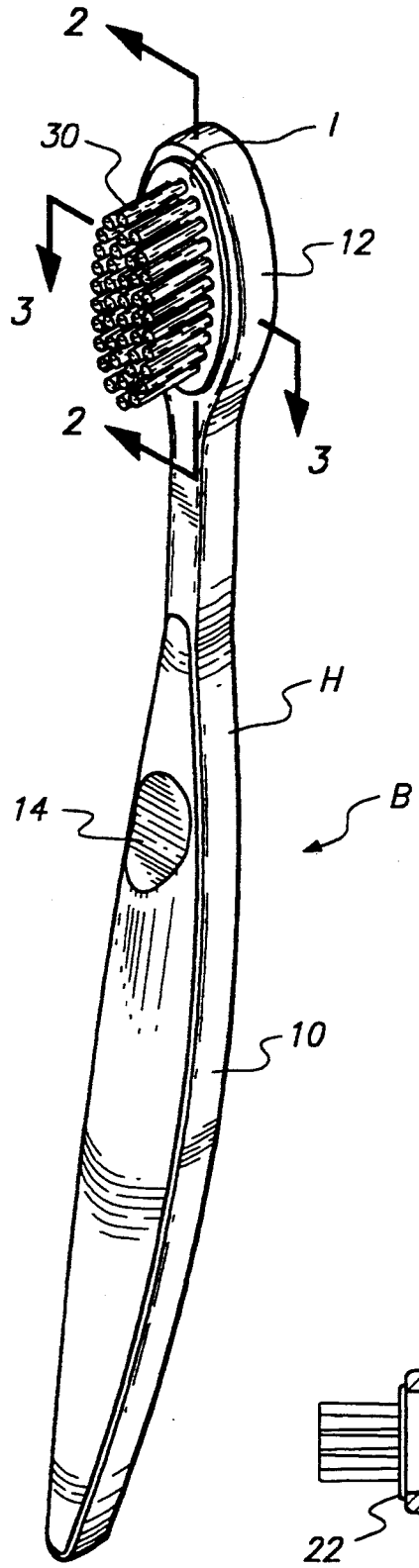
FIG. 1 is a perspective view of the toothbrush, with the insert in place.

The handle is of an integral construction and formed with an elongate gripping portion 10 having an open loop 12 of an ovoid configuration formed at one end thereof. The gripping portion is of a slightly arcuate configuration, as may be seen from FIG. 1, and has a finger depression 14 formed on one side. The loop 12 is symmetrical and formed with an internal shoulder 16 at one side thereof. To the side of the shoulder the loop is formed with a slightly divergent surface 18. Ideally the divergence is approximately 120, as seen by the angle $\alpha$ in FIG. 1.

The insert I is of an ovoid configuration complemental to that of the interior of the loop 12 and comprises: a body section 20 having a slightly tapered exterior surface adapted to mate with the interior surface 18 of the loop; a 360° flange 22 adapated to sealingly mate with one side of the loop 12 when the brush insert is fully in place within the loop; and, a 360° bead 24 adapated to snap past and engage the shoulder 16 to the side of the handle opposite that engaged by the flange 22. In the preferred embodiment, the side of the insert on which the bead 24 is formed extends approximately 0.030 of an inch beyond the side of the handle when the insert is fully engaged within the loop (see FIG. 2C). Such projection of the insert from the handle assures that the insert is securely held in place within the loop and also provides a raised surface on the insert to which pressure may be applied to eject the insert from the loop.

Figure 2A:
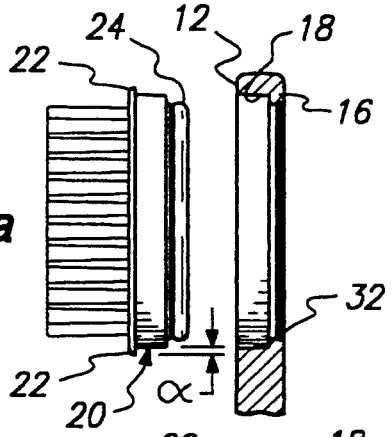
FIG. 2*a, b* and *c* are cross-sectional views taken on the plane designated by line 2—2 of FIG. 1, progressively illustrating the manner in which the brush may be engaged with and removed from the handle.
Figure 2B:
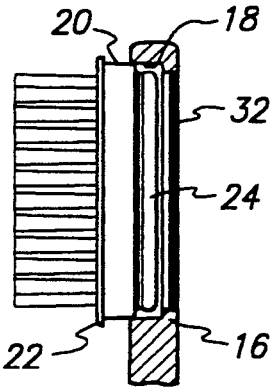
Figure 2C:
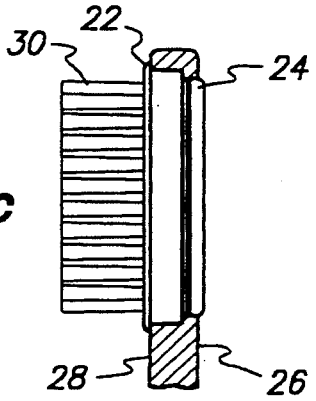

FIG. 2*a* shows the insert and handle in an exploded-view aligned with one another. FIG. 2*b* shows the insert as it is moved into the loop from the exploded condition shown in FIG. 2*a*. FIG. 2*c* shows the insert after it has been pushed fully into the loop, with the bead 24 snapped past and into secured sealed engagement with the shoulder 16. In the latter condition, the flange 22 is sealingly engaged with the side of the loop opposite of that engaged by the bead. For purposes of description, the side of the loop engaged by the bead is designated by the numeral 26 and that engaged by the flange 22 is designated by the numeral 28. Bristles 30 are shown extending from the side of the insert about which the flange 22 is formed.

In the preferred embodiment, a slightly beveled surface 32 is formed on the portion of the shoulder 16 which opens through the side 26. This surface facilitates snapping of the insert into and out of the loop and also provides a smooth surface against which the bead 24 may seat to form a seal.

Figure 3:
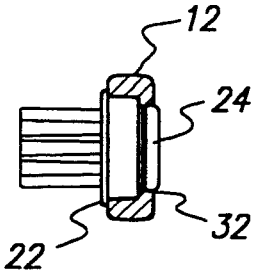
FIG. 3 is a cross-sectional view taken on the plane designated by line 3—3 of FIG. 1.
Figure 4:
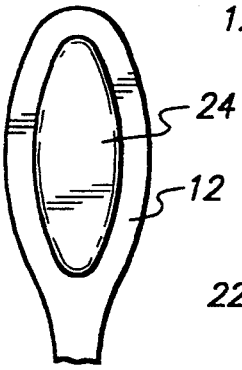
FIG. 4 is a plan view of the head of the toothbrush with the brush insert in place, taken from the side opposite that from which the bristles extend.
Figure 5:
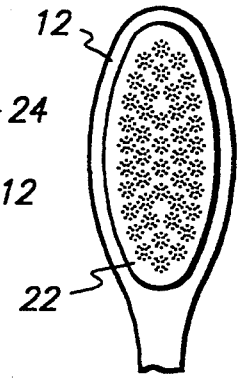
FIG. 5 is plan view of the head of the brush with the insert in place, taken from the side from which the bristles extend.

FIG. 4 illustrates the manner in which the bead 24 engages the beveled surface 32 of the shoulder 16 through a full 360°. FIG. 5 similarly shows the manner in which the flange 22 engages the side 28 through a full 360°. From these figures, and the cross-sectional views of FIG. 2*c* and FIG. 3, it can be seen that the engaged insert is fully sealed to the loop of the handle about a full 360° on both sides of the handle.

The process of ejecting the insert from the handle is essentially a reverse of the insertion procedure. In this process, with the insert fully engaged as shown in FIG. 2*c*, pressure is applied to move the insert outwardly of the loop as shown in FIG. 2*b*. Continued pressure functions to fully eject the insert, as shown in FIG. 2*a*. To facilitate ejection, the user would typically press on one of the narrower ends of the insert to get the injection step started. In this way, the pressure required to initiate snapping of the insert out of the loop is minimized. Once one end of the bead is disengaged from the shoulder, the remainder of the insert easily follows.

The symmetrical ovoid configurations of the mating insert and loop enable the insert to be placed in either of two positions rotated 180° from one another. This simplifies the insertion process in that the user simply has to align the insert with the loop and does not need to be concerned about which end of the insert is at which end of the loop. It also enables the insert to be turned 180° after the brush has been in use. Such turning enables the user to rotate the brush if the bristles on one side are wearing faster than those on the other.

CONCLUSION

The present invention provides an improved polymeric toothbrush with a removable insert. It is particularly advantagous in that when in place the insert is fully sealed within the handle and yet may be readily removed therefrom. It should be appreciated, however, that the invention is not intended to be limited to the specifics of the illustrated embodiment, but rather as defined by the accompanying claims.

We claim:

1. A tooth brush comprising:

a) an elongate handle having an open loop formed at one end thereof said loop having two oppositely disposed open sides;

b) a brush insert proportioned for receipt in the open loop, said insert having:

1) a flange extending therearound for generally sealed engagement with one side of the loop when the insert is received within the loop; and, 2) a bead extending therearound for engagement with the loop on the side thereof opposite that engaged by the flange when the insert is received within the loop;

c) a shoulder formed interiorly of and extending around the loop adjacent said opposite side, said shoulder being of a shape and size complemental to and slightly less than that of the bead whereby the bead may resiliently deflect the loop to snap past the shoulder to engage said opposite side of the loop.

2. A tooth brush according to claim 1 wherein:

a) the loop is of an elongate ovoid configuration; and b) the insert is of an elongate ovoid configuration complemental to that of the loop.

3. A tooth brush according to claim 2 wherein the ovoid configurations of the loop and insert are symmetrical whereby the insert may be received in the loop in either of two different positions disposed one hundred and eighty degrees relative to one another.

4. A tooth brush according to claim 2 wherein a portion of the insert of an ovoid configuration corresponding substantially to that of the loop is located outside the loop on said opposite side when the bead is engaged with said opposite side.

5. A tooth brush according to claim 1 wherein the bead sealingly engages said opposite side of the loop.

6. A tooth brush according to claim 1, wherein the loop has an enlarged diameter section for slidable receipt of the insert and a reduced diameter section which provides the shoulder.

7. A tooth brush according to claim 6 wherein:

a) the enlarged diameter section of the loop converges from said one side towards said opposite side; and, b) the insert is of a convergent configuration complemental to that of the loop.

8. A tooth brush according to claim 1 wherein the handle and loop are integrally formed of a polymeric material and the loop is resilient to permit the loop to deflect as the bead snaps past the shoulder.

9. A tooth brush comprising:

a) an elongate handle having an open loop of a symmetrical configuration at one end thereof said loop having two oppositely disposed open sides, the loop having a shoulder extending therearound adjacent one side of the loop;

b) a replaceable brush insert complementally receivable in the open loop;

c) bead means extending around the insert to snap to said one side of the loop to secure the insert therein, said bead means adapted to snap over said shoulder when the insert is secured in the loop; and, d) flange means extending around the insert for sealed engagement with the loop on the side thereof opposite said one side upon secure receipt of the insert within the loop.

10. A tooth brush according to claim 9 wherein the bead means and flange means extend fully around the insert to form a seal around the oppositely disposed sides of the loop when the insert is received within the loop.

11. A tooth brush according to claim 9 wherein a portion of the insert corresponding substantially to that of the loop is spaced outwardly from the loop when the bead means is snapped to said one side of the loop.

12. A tooth brush according to claim 9, wherein the loop has an enlarged diameter section for slidable receipt of the insert and a reduced diameter section which provides the shoulder.

13. A tooth brush according to claim 12 wherein:

a) the enlarged diameter section of the loop converges towards said one side; and, b) the insert is of a convergent configuration complemental to that of the loop.

14. A tooth brush according to claim 9 wherein the handle and loop are integrally formed of a polymeric material and the loop is resilient to permit the bead means to snap through and to said one side of the loop.

* * * * *